US007691236B2

(12) United States Patent
Conn et al.

(10) Patent No.: US 7,691,236 B2
(45) Date of Patent: Apr. 6, 2010

(54) CREPING BLADE WITH A HIGHLY SMOOTH BEVEL SURFACE

(75) Inventors: Richard Harvey Conn, Channing, MI (US); Robert Charles Dreisig, West Chester, OH (US)

(73) Assignee: The Procter + Gamble Company, Cincinnati, OH (US)

( * ) Notice: Subject to any disclaimer, the term of this patent is extended or adjusted under 35 U.S.C. 154(b) by 188 days.

(21) Appl. No.: 11/493,263

(22) Filed: Jul. 26, 2006

(65) Prior Publication Data

US 2008/0023168 A1 Jan. 31, 2008

(51) Int. Cl.
*D21G 3/04* (2006.01)
*D21G 3/00* (2006.01)

(52) U.S. Cl. ..... 162/281; 162/280; 118/413; 15/256.51

(58) Field of Classification Search ..... 162/280–281; 118/413; 15/256.51; 134/122 R
See application file for complete search history.

(56) References Cited

U.S. PATENT DOCUMENTS

| | | | | |
|---|---|---|---|---|
| 2,972,767 | A * | 2/1961 | Smith | 15/256.51 |
| 3,507,745 | A * | 4/1970 | Fuerst | 162/281 |
| 3,703,019 | A * | 11/1972 | Bratt | 15/256.51 |
| 3,869,344 | A | 3/1975 | Hunt | |
| 3,882,817 | A | 5/1975 | Zink | |
| 3,973,845 | A * | 8/1976 | Lindblad et al. | 399/350 |
| RE29,417 | E * | 9/1977 | Lee et al. | 162/274 |
| RE29,418 | E * | 9/1977 | Hunt | 162/274 |
| 4,185,399 | A * | 1/1980 | Gladish | 34/120 |
| 4,549,933 | A | 10/1985 | Judd et al. | |
| 4,600,599 | A | 7/1986 | Wallsten | |
| 4,789,432 | A | 12/1988 | Goodnow et al. | |
| 4,906,335 | A | 3/1990 | Goodnow et al. | |
| 4,919,756 | A | 4/1990 | Sawdai | |

(Continued)

FOREIGN PATENT DOCUMENTS

| | | |
|---|---|---|
| DE | 20 30 882 A1 | 12/1970 |

(Continued)

*Primary Examiner*—José A Fortuna
(74) *Attorney, Agent, or Firm*—James E. Oehlenschlager; Betty J. Zea

(57) ABSTRACT

The present invention relates to a doctor blade comprising: a body having a thickness, a sharp leading side, a trailing side, and working end comprising a bevel surface, wherein the bevel surface is defined by a leading edge and a trailing edge, and wherein the $R_a$ of the bevel surface is from about 1 μ-in to about 7 μ-in. The present invention further relates to a method of removing a material from a surface of a piece of equipment, the method comprising providing a material on the surface of the piece of equipment; providing a doctor blade adjacent to the surface of the equipment, the creping blade having a working end including a leading edge, which is disposed closest to the surface of the equipment, a trailing edge disposed farthest from the surface of the equipment and a bevel surface disposed therebetween; passing the surface of the equipment past the doctor blade or the doctor blade past the surface of the equipment such that the material impacts the doctor blade and at least a portion of the material is removed from the surface of the piece of equipment; and passing the removed material over the bevel surface of the doctor blade wherein the $R_a$ of the bevel surface is from about 1 to about 7 μ-in.

13 Claims, 3 Drawing Sheets

U.S. PATENT DOCUMENTS

| | | | | |
|---|---|---|---|---|
| 5,032,229 | A | 7/1991 | Boucher | |
| 5,035,196 | A | 7/1991 | Mannio | |
| 5,110,415 | A | 5/1992 | Boucher et al. | |
| 5,356,519 | A | 10/1994 | Grabscheid et al. | |
| 5,403,446 | A | 4/1995 | Trelsmo et al. | |
| 5,489,364 | A | 2/1996 | Marinack | |
| 5,507,917 | A | 4/1996 | Didier et al. | |
| 5,512,139 | A | 4/1996 | Worcester | |
| 5,674,361 | A | 10/1997 | Marinack | |
| 5,728,434 | A | 3/1998 | Hewitt | |
| 5,783,042 | A | 7/1998 | Leeman et al. | |
| 5,849,158 | A | 12/1998 | Costello et al. | |
| 5,863,329 | A | 1/1999 | Yamanouchi | |
| 5,944,958 | A | 8/1999 | Svanqvist | |
| 6,027,614 | A | 2/2000 | Parker et al. | |
| 6,027,765 | A | 2/2000 | Kaneko | |
| 6,042,693 | A | 3/2000 | Marinack | |
| 6,066,234 | A | 5/2000 | Parker et al. | |
| 6,074,526 | A | 6/2000 | Marinack | |
| 6,078,771 | A | 6/2000 | Buchanan et al. | |
| 6,113,470 | A | 9/2000 | Marinack | |
| 6,139,638 | A | 10/2000 | Dubois et al. | |
| 6,207,021 | B1 | 3/2001 | Eriksson et al. | |
| 6,328,853 | B1 | 12/2001 | Goodnow et al. | |
| 6,416,843 | B1 | 7/2002 | Rata et al. | |
| 6,419,748 | B1 | 7/2002 | Kaneko | |
| 6,423,427 | B1 | 7/2002 | Mehmood | |
| 6,491,754 | B1 | 12/2002 | Graf et al. | |
| 6,527,913 | B1 | 3/2003 | Johnson et al. | |
| 6,558,510 | B1 * | 5/2003 | Edwards et al. | 162/111 |
| 6,565,712 | B2 | 5/2003 | Lindenfelser | |
| 6,565,991 | B1 | 5/2003 | Mehmood | |
| 6,643,890 | B2 | 11/2003 | Carrier | |
| 6,682,012 | B1 | 1/2004 | Parviainen et al. | |
| 6,687,950 | B1 | 2/2004 | Rata et al. | |
| 6,712,905 | B2 | 3/2004 | Narmi et al. | |
| 6,758,944 | B2 | 7/2004 | Kirjava et al. | |
| 6,830,659 | B2 | 12/2004 | Sovijarvi | |
| 6,837,930 | B2 | 1/2005 | Kaneko | |
| 6,867,155 | B2 | 3/2005 | Brauns et al. | |
| 7,108,766 | B1 | 9/2006 | Eskelinen et al. | |
| 7,431,801 | B2 * | 10/2008 | Conn et al. | 162/281 |
| 2002/0098376 | A1 | 7/2002 | Morris | |
| 2002/0174966 | A1 | 11/2002 | Brauns et al. | |
| 2002/0176934 | A1 | 11/2002 | Rata et al. | |
| 2002/0189777 | A1 | 12/2002 | Rata et al. | |
| 2003/0106656 | A1 | 6/2003 | Johnson et al. | |
| 2004/0123965 | A1 | 7/2004 | Isometsa et al. | |
| 2005/0051292 | A1 * | 3/2005 | Laithier et al. | 162/281 |
| 2005/0172444 | A1 * | 8/2005 | Carrier | 15/256.51 |
| 2006/0162881 | A1 * | 7/2006 | Conn et al. | 162/111 |
| 2007/0158045 | A1 * | 7/2007 | Sundqvist et al. | 162/281 |
| 2008/0023168 | A1 * | 1/2008 | Conn et al. | 162/281 |

FOREIGN PATENT DOCUMENTS

| | | | |
|---|---|---|---|
| DE | 10214392 | | 10/2003 |
| EP | 1 182 293 | A1 | 2/2002 |
| EP | 1 391 552 | A1 | 2/2004 |
| JP | 6262145 | | 9/1994 |
| JP | 6346398 | | 12/1994 |
| JP | 11-100790 | | 4/1999 |
| JP | 2002173887 | | 6/2002 |
| WO | WO 98/27279 | | 6/1998 |
| WO | WO 99/04091 | | 1/1999 |
| WO | WO 01/20077 | A1 | 3/2001 |
| WO | WO 03/097890 | A2 | 11/2003 |
| WO | WO 2004/005614 | A1 | 1/2004 |
| WO | WO 2004/005615 | A1 | 1/2004 |
| WO | WO 2006081502 | A1 * | 8/2006 |
| WO | WO 2008012775 | A1 * | 1/2008 |

* cited by examiner

CREPING BLADE WITH A HIGHLY SMOOTH BEVEL SURFACE

FIELD OF THE INVENTION

The present invention relates generally to creping blades, and more specifically to creping blades and the like that have unique bevel surface profile and/or an improved effectiveness.

BACKGROUND OF THE INVENTION

Doctor blades have been used for years in various different applications. Typically, a doctor blade is used to help separate a material from a piece of equipment. For example, a doctor blade may be used to help remove a web of material from a drum or plate to which the material has been attached. Doctor blades may also be used to clean equipment and/or to impart one or more characteristics into the product being manufactured by the equipment.

In the paper industry, for example, doctor blades are often used to help remove the paper web from a drying drum, such as a Yankee dryer to which the paper web is adhered. In certain papermaking processes, the doctor blade that removes the paper web from the drying drum or any other drum may also be used to crepe the paper to some degree. Such doctor blades are often referred to as "creping blades". In other papermaking processes, the doctor blade may be used to remove waste material from various pieces of equipment. Such doctor blades are often referred to as "cleaning blades". The present invention is directed to doctor blades, and more particularly to creping blades and cleaning blades used in papermaking and other web making processes.

The surface profile of bevel surface of the doctor blade, in addition to the geometry of the doctor blade and the particular set-up configuration of the doctor blade with respect to the equipment with which it interacts, can provide for variations in the way the creping blade performs its intended function. For example, it has been discovered that microscopic bumps, machine marks, or surface abnormalities on the creping blade bevel surface can affect the blade's performance and/or the physical characteristics of the material being removed by the blade.

The present prior art methods of improving the performance of doctor blades include changing the geometry of the leading edge of the blade, introducing grooves into the leading edge of the blade, using composite materials, and treating the surface of the blade. Unfortunately, the current methods of improving doctor blades fail to account for the imperfections in the bevel surface of the blade that result from the machine marks left from the processing of the blade itself after conventional finishing.

There are generally two methods to prepare the finished bevel surface of a doctor blade. One is by the conventional use of abrasive media, typically by grinding methods using abrasive stones, wheels, or other abrasive media. Another is to pare material off the surface of the bevel in single or multiple strokes in order to create a working edge or bevel surface. This paring method is known in the art as "skiving." Bumps and other imperfections are not limited to blades which have been machined in perpendicular to the z-axis of the leading edge of the blade itself; even blades prepared by a skiving process in which the tool marks are parallel with the z-axis of the leading edge of the blade exhibit microscopic bumps along the surface. An emphasis must be placed on machine tool directionality of the effect that it has on the process removing or separating material (for example, a cellulose web) from a rotating drying drum or other equipment. The machine tool mark orientation in papermaking processes are often arranged in the machine direction (MD) (the same direction of web movement) as opposed to the cross direction (CD) (perpendicular to the web movement) because of factors such as lower sheet drag or friction and pitch (residual material from the raw material or processing steps) build up.

Despite the vast amount of information available relating to the manufacture of doctor blades, there is still a need to improve the performance of creping blades and to provide creping blades that can uniquely affect the physical attributes of the materials with which they interact. Due to the way that a creping blade is typically used in the web making process (i.e., the web is removed from a drying roll at high speed by impacting the web against the creping blade), the creping blade can, and often does, cause problems with throughput, tearing of the web, reducing the strength of the web, generating dust, etc.

The present invention provides improved creping blades that address many of the problems presented by currently available creping blades. Specifically, it has been newly discovered that the bevel surface of the blade can be modified to provide unique benefits to the processes and/or materials with which the creping blade interacts. More specifically, it has been found that a step-like polishing process can be used to super-finish the bevel surface of the doctor blade. The super-finished doctor blades exhibit dramatic improvements in performance. Examples of such improvements include, but are not limited to, line speed increases, increased line run times, increased line reliability, improvement in sheet stability, reduction in the amount of dust or other material derived from the web interacting with the blade and/or can provide the product being manufactured with unique physical attributes or improvements of existing desirable attributes not easily attainable by using the doctor blades that are currently commercially available. This includes higher sheet strength or tensile in both the CD and MD direction, and more consistent product attributes especially in the CD direction of the sheet such as caliper and tensiles versus a higher variability with blades that have smoothness imperfections.

Further, the blades of the present invention can provide a less traumatic interaction with the paper web, which can help reduce the amount of material needed to form a particular end product in certain circumstances and/or allow for the use of less expensive materials to produce the desired end product.

The present invention addresses one or more of the disadvantages of currently available creping blades and methods using such creping blades by providing a smoother bevel surface for the creping blade.

SUMMARY OF THE INVENTION

One embodiment of the present invention relates to a doctor blade comprising: a body having a thickness, a sharp leading side, a trailing side, and working end comprising a bevel surface. The bevel surface is defined by a leading edge and a trailing edge, wherein the $R_a$ of the bevel surface is from about 1 μ-in to about 7 μ-in.

Another embodiment of the present invention relates to a method of removing a material from a surface of a piece of equipment, the method comprising:

a) providing a material on the surface of the piece of equipment;

b) providing a doctor blade adjacent to the surface of the equipment, the creping blade having a working end including a leading edge, which is disposed closest to the surface of the equipment, a trailing edge disposed farthest from the surface of the equipment and a bevel surface disposed therebetween;

c) passing the surface of the equipment past the doctor blade or the doctor blade past the surface of the equipment such that the material impacts the doctor blade and at least a portion of the material is removed from the surface of the piece of equipment;

e) passing the removed material over the bevel surface of the doctor blade wherein the $R_a$ of the bevel surface is from about 1 to about 7 μ-in.

Still another embodiment of the present invention relates to a doctor blade comprising: a body having a thickness, a sharp leading side, a trailing side, and working end comprising a bevel surface, wherein the bevel surface is defined by a leading edge and a trailing edge, wherein the $R_a$ of the bevel surface is from about 1 μ-in to about 7 μ-in, the blade is from about 40 inches to about 300 inches in length, the blade is from about 4 inches to about 6 inches in height, the blade is from about 0.01 inches to about 0.10 inches in thickness, and wherein the bevel angle is from about 0 to about 45 degrees.

DETAILED DESCRIPTION OF THE INVENTION

Figure 1A:
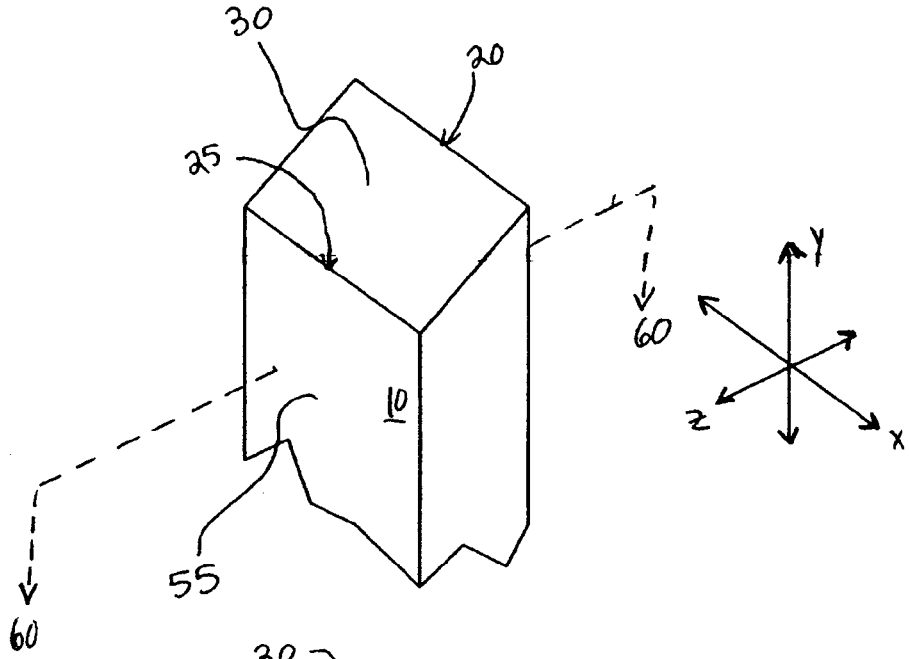
FIGS. 1(A)-(D) are partial, enlarged, perspective views of different embodiments of the present invention doctor blades.
Figure 1B:
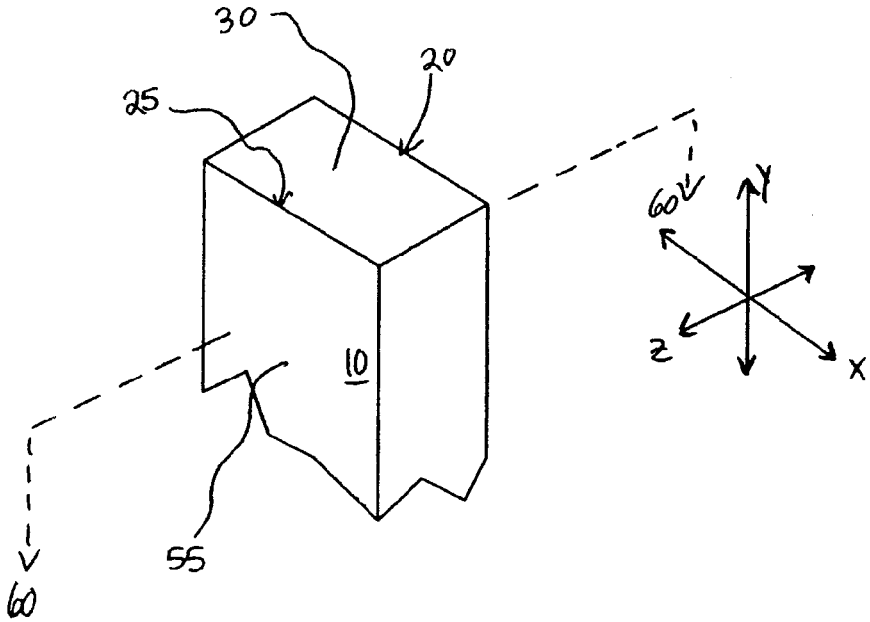
Figure 1C:
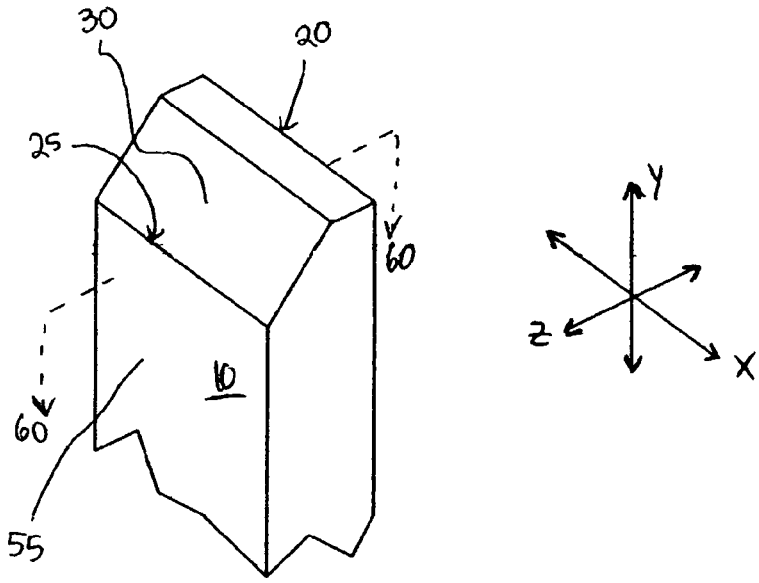
Figure 1D:
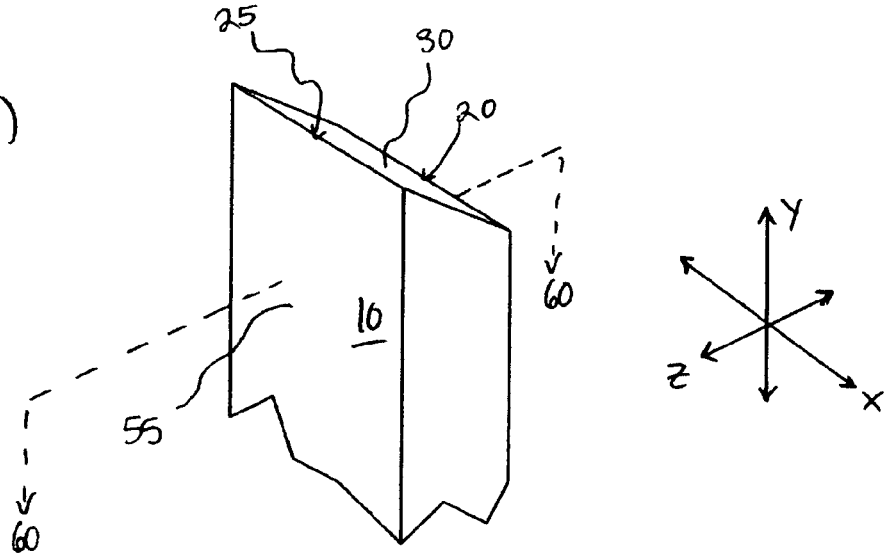
Figure 2:
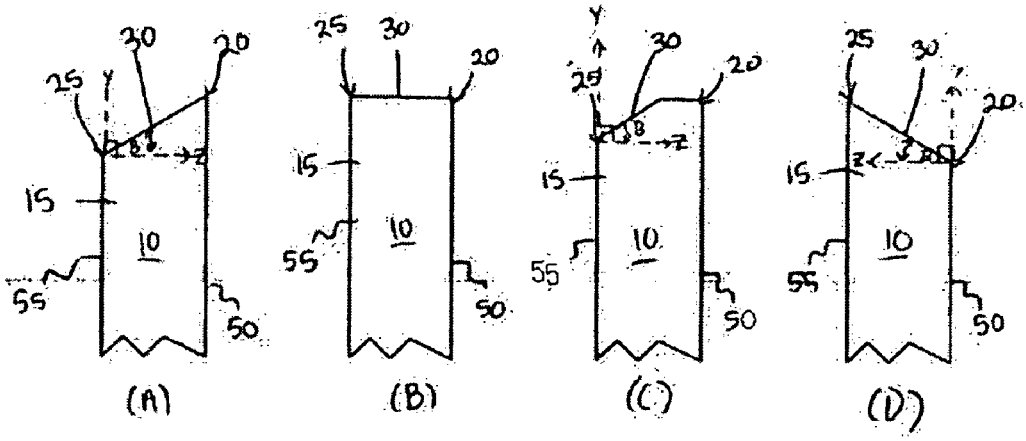
FIGS. 2(A)-(D) are partial, enlarged, cross-sectional views of different embodiments of the present invention doctor blades taken along line 60-60 of FIGS. 1(A)-(D), respectively.

"Smoothness" as used herein refers to the planarity of a surface. Smoothness is measured by $R_a$. $R_a$ is a surface texture parameter well known in the art and is the arithmetical mean deviation of the profile. It was formerly known as the arithmetic average deviation "AA" or the center line average deviation "CLA". $R_a$ is the area between the roughness profile of a surface and the mean line of the surface. In other words, $R_a$ is the integral of the absolute value of the roughness profile height over the evaluation length:

$$R_a = \frac{1}{L}\int_0^L |r(x)|\,dx$$

where L is the length of the mean line in the x-direction and r(x) is the profile of the bevel surface in the x-direction.

"Bevel" or "bevel surface" as used herein refers to the portion of the blade that forms the surface between the leading edge of the blade and the trailing side of the blade and is typically the "working surface" of the blade.

"Highly polished" as used herein refers to a surface that has been processed by a sequential progression from relatively rough grit to fine grit with suitable lubrication and is highly planar and substantially free of defects. Such sequential progression will be referred to herein as a "step polishing process."

"Doctor blade" as used herein refers to a blade that is disposed adjacent to another piece of equipment such that the doctor blade can help remove from that piece of equipment a material that is disposed thereon. Doctor blades are commonly used in many different industries for many different purposes, such as, for example, their use to help remove material from a piece of equipment during a process. Examples of materials include, but are not limited to, tissue webs, paper webs, glue, residual buildup, pitch, and combinations thereof. Examples of equipment include, but are not limited to, drums, plates, Yankee dryers, and rolls. Doctor blades are commonly used in papermaking, nonwovens manufacture, the tobacco industry, and in printing, coating and adhesives processes. In certain instances, doctor blades are referred to by names that reflect at least one of the purposes for which the blade is being used.

"Creping blade" or "creper blade" as used herein, refers to a doctor blade used in the papermaking industry to remove a paper web from a drum and to provide some "crepe" or fold to the web. In terms of this application, creping blades have the dual function of removing a web from a piece of equipment, such as, for example a Yankee dryer, and providing the web with crepe.

"Cleaning blade" as used herein, refers to a doctor blade used to clean a surface.

"Machine Direction" or "MD" as used herein, refers to the direction parallel to the flow of the fibrous structure through the papermaking machine and/or product manufacturing equipment.

"Cross Machine Direction" or "CD" as used herein, refers to the direction perpendicular to the machine direction in the same plane of the fibrous structure and/or fibrous structure product comprising the fibrous structure.

"Bevel surface length," as used herein, refers to the length of the blade along the bevel surface following a line perpendicular with the leading edge of the blade that goes between the leading edge and the trailing edge.

"Sheet control" as used herein, refers to the lack of vibrations, turbulence, edge flipping, flutter, or weaving of the web that result in a loss of control at higher speeds.

FIGS. 1(A)-1(D) are nonlimiting examples of doctor blades in accordance with the present invention. In each case, a perspective view of the working end of the blade 10 is shown. The blade 10 has a leading edge 20, a trailing edge 25, and a bevel surface 30. The leading edge 20 of the blade 10 is typically disposed closest to the corresponding piece of equipment such as a drum 35, shown in FIG. 3. The trailing edge 25 is that portion of the blade that is typically disposed farther from the corresponding equipment from which the material is being removed than the leading edge 20. Thus, the trailing edge 25 is typically located downstream from the leading edge 20 and the bevel surface 30 is located between the leading edge 20 and the trailing edge 25. What this means, from a process flow standpoint, is that the bevel surface 30 and trailing edge 25 follow after the leading edge 20.

Doctor blades with cross section 60-60 of FIGS. 1(A)-1(D), respectively, are shown in FIGS. 2(A)-2(D). In each case, a fragmentary cross section perspective view of the working end of the blade 10 is shown. The working end 15 of the blade 10, or that portion of the blade 10 that is placed in contact with, or adjacent to, the corresponding piece of equipment from which the web, or other material is to be removed. The leading edge 20 is that portion of the blade 10 that is disposed between the leading side 50 of the blade 10 and the bevel surface 30. The leading side 50 is parallel to the trailing side 55.

Figure 3:
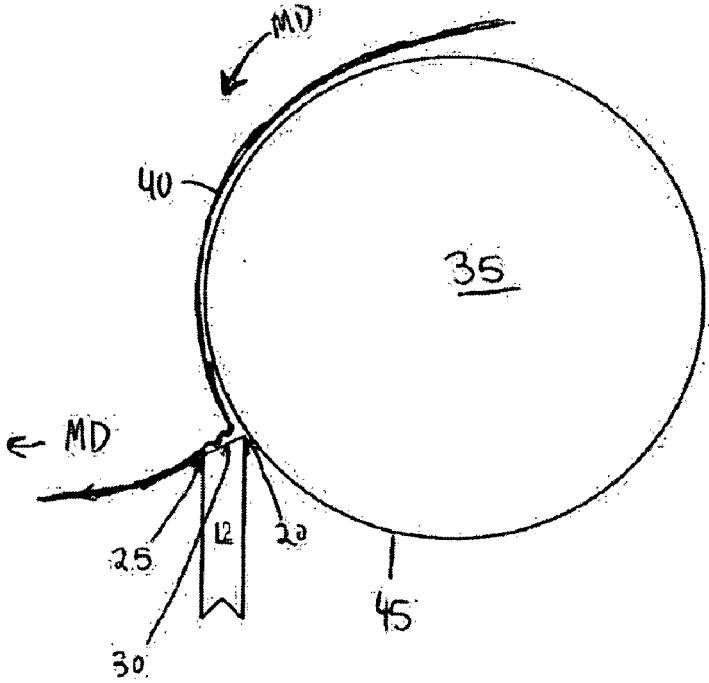
FIG. 3 is a depiction of a doctor blade of the present invention art being used to remove a material from a roll.

FIG. 3 is a depiction of a portion of an exemplary embodiment of a typical papermaking process including the use of a creping blade 12 to remove a paper web from a drum 35. As shown, the web 40 moves in the machine direction MD along the surface 45 of the drum 35 until it impacts the leading edge 20 of the creping blade 12. In this case, the creping blade 12 removes the web 40 from the drum 35 and also provides "crepe" or micro and/or macro folds in the web 40 before it passes over the trailing edge 25 of the blade 12.

Although not wishing to be limited by theory, it is known in certain manufacturing processes, such as papermaking, the web impacting the creping blade first contacts the creping blade in such a way that imperfections in the smoothness of the bevel surface provides significant undesirable frictional forces or microscopic sites that can disrupt the processing of the web. For webs, such as nonwoven webs and paper webs, such friction or snags or higher and variable coefficients of friction from portion of the bevel surface to another can lead to unwanted interaction between the blade and the web. As a result, material may be dislodged from the web (e.g. fibers) and, in turn, this material may generate dust or debris, slow throughput, increase web breaks, increase scrap, increase machine downtime and or increase equipment damage. Further, the blades 10 of the present invention can provide a less traumatic interaction with the materials with which they interact. The end result being a paper machine that exhibits superior sheet control, line speed increases, lower costs, and higher throughput.

Although it has been known for some time that the physical characteristics of the doctor blade 10 may affect the process in which the blade 10 is used as well as the physical attributes of the material (e.g., web 40) contacted by the doctor blade 10, it has heretofore been unknown as to how a high level of smoothness in the bevel surface 30 can be achieved. As used herein, the term "highly smooth" refers to a surface that has an $R_a$ of less than about 7 μ-in as measured by the surface roughness method outlined below.

The present invention is directed to a unique surface profile of the bevel surface 30 of the doctor blade 10, the methods for making such doctor blades, and the effects that such blades have on the processes and materials with which they interact. Specifically, the present invention is directed to a doctor blade that has a bevel surface that is smoother than (as measured by the Surface Roughness Method) prior art doctor blades. That is, the doctor blade of the present invention has an $R_a$ of from about 1 μ-in to about 7 μ-in, in another embodiment, the creping blade has an $R_a$ of from about 1.5 μ-in to about 5 μ-in, in still another embodiment, the doctor blade has an $R_a$ of from about 2 μ-in to about 4 μ-in.

The bevel, leading edge, and trailing edge of the blade can have any shape so long as it delivers the desired properties set forth herein. FIG. 3 shows an example of a creping blade 12 of the present invention disposed adjacent a drum 35, as it would be in a typical papermaking process. The web 40 is shown being removed from the surface 45 of the drum 35 by the creping blade 12. The creping blade 12 is also shown providing crepe to the web 40 before it passes off the bevel surface 30 of the blade 12. Due to the superior smoothness of the bevel surface 30 of the blade 12, the web 40 can more easily flow off the bevel surface 30 as it moves away from the blade 12 in the machine direction MD. It is this point in the process where the benefits of the blades 12 of the present invention are believed to be achieved. As shown in FIG. 3, the web 40 passes over the bevel surface 30 during the papermaking process. Typical creping blades have an $R_a$ over 7 pin and, as a result, provide a relatively high level of friction against the web 40 as the web contacts the bevel surface 30 of the blade. The friction generated between the web 40 and the bevel surface 30 of the blade is believed to be responsible for many of the negative factors set forth herein with respect to current creping techniques. The bevel surfaces 30 of the blades 12 of the present invention provide relatively less friction against the web 40 than current blades 12 and thus are able to reduce many of the negatives associated with creping. It has been found, for example, that such blades 12 can provide for improved web control, improved sheet stability, increased line speeds, better machine reliability, less dust, and/or improved caliper or other product attributes.

The creping blades 12 and doctor blades 10 of the present invention can be used for any purpose and should not be considered to be limited to the examples set forth herein. The creping blades 12 generally have the same geometry as doctor blades 10. As noted above, doctor blades 10 are typically used to help remove a material from the surface of a piece of equipment, wherein the surface of the piece of equipment moves past the creping blade 10 or the blade 10 moves over the surface of the piece of equipment on which the material to be removed is disposed. Further, the doctor blade 10 can have more than one purpose or use in the process in which it is used. Often, doctor blades 10 and creping blades 12 are used not only to remove material from a passing surface and crepe the material, but also to cut the material, split the material, scrape a surface, clean a surface, control the amount of material coating on a surface, and/or provide a means for controlling the material that is being removed, such as, for example, to provide a directional change or tension point for controlling a moving web. One or more of these functions can be provided by a single blade 10 or can be provided by two or more blades 10 in a manufacturing process. If two or more doctor blades 10 are used, the blades 10 can be the same or differ in their geometry, make-up, or any other attribute as well as their intended use and location in the process.

The doctor blades 10 of the present invention can be made from any material or materials suitable for the particular purpose of the doctor blade 10, whether the material(s) is now known or later becomes known. For example, doctor blades 10 are often made from metals, ceramics or composite materials, but can also be made from plastic, carbon, glass, stone or any other suitable material or combination of materials. Similarly, the doctor blades 10 of the present invention can be coated from any material or materials suitable for the particular purpose of the doctor blade 10, whether the material(s) is now known or later becomes known. For example, doctor blades 10 are sometimes coated with high molecular weight wear-resistant coatings.

Further, the doctor blade 10 may vary in any of its dimensions, such as height, length and/or thickness, as well as bevel angle B and the geometry of any side and/or surface of the blade 10. The doctor blade 10 can be a single-use blade or a blade that is reused with or without being reground, refurbished or otherwise restored to allow the blade 10 to be reused after it has been taken out of service for any particular reason. The doctor blade 10 can have only a single working end 15 or can have two or more working ends (for purposes of simplification, the creping blades 10 shown herein have a single working end 15). Further, the doctor blade 10 could have multiple leading edges 20 and trailing edges 25 on any working end 15.

Suitable doctor blades 10 for use in a papermaking process are, for example, creping blades available from ESSCO Incorporated of Green Bay, Wis. and/or James Ross Limited of Ontario, Canada. The blades 10 are made from a martensitic stainless steel and have dimensions of from about 40 inches to about 300 inches in length, from about 2 inches to about 8 inches in height and from about 0.01 inches to about 0.10 inches in bevel surface length. In another embodiment of the present invention, the blades 10 have a length of from about 100 inches to about 250 inches, in yet another embodiment, the blades 10 have a length of from about 190 inches to about 200 inches. In another embodiment, the blades 10 have a height of from about 4 inches to about 6 inches. In yet another embodiment, the blades have a bevel surface length of from about 0.02 inches to about 0.08 inches. In still another embodiment, the blades have a bevel surface length of from about 0.04 inches to about 0.06 inches. The blade 10 can have any bevel angle B, but it has been found that a bevel angle B between about 0 degrees and about 45 degrees may be suitable for tissue and/or towel applications. In another embodiment of the invention, the bevel angle B is between about 15 degrees and about 30 degrees.

In one embodiment of the present invention, the blades measured about 209 inches in length, about 5 inches in height and about 0.050 inches in thickness. The bevel angle of the same embodiment is 16 degrees. Based on these dimensions, the blade has a bevel surface area of 209 inches by 0.052 inches, or 10.87 $in^2$.

The blades 10 each have a sharp leading edge 20 and trailing edge 25, as well as a highly polished and smooth bevel surface 30 as described herein. However, the bevel surface 30 is modified in accordance with the present invention such that, for example, the bevel surface 30 has an $R_a$ of less than about 7 μ-in. The highly polished surface of the bevel 30 may be provided by a step-polishing process or otherwise removing imperfections from the bevel 30 that is provided by the blade manufacturer.

Securing the Sample

In one embodiment of the invention, one or more blades are secured together during the step-polishing process. In another embodiment of the invention, from about 2 to about 20 blades are secured at once. In yet another embodiment of the invention, from about 5 to about 10 blades are secured at once.

Any method of securing the blades that is known in the art can be used so long as the dampening characteristics and force of that method of securing are maximized in order to reduce the chatter, movement, and vibration of the blades within the equipment and so that the force is evenly distributed across the surface of the blade. Further, the grinding machine and abrasive media must be set to control precisely within downfeed tolerances of one ten-thousandths of an inch or less, measured on the downfeed rate of the abrasive material itself, including being able to stop the downfeed pressure within one ten-thousandths of an inch and hold it there for the final stages of the polishing and smoothing process for long periods of time. In one embodiment, the blades are held for from about 20 strokes to about 40 strokes with no downfeed pressure at traverse speeds of from about 0.05 m/s to about 0.5 m/s.

In a particular embodiment of the present invention, the clamp is a hydraulic clamp fixture. A total clamping force of from about 10,000 lbs to about 18,000 lbs is used to secure the doctor blades. In another embodiment of the present invention, a total clamping force of from about 12,000 lbs to about 16,000 lbs is used to secure the doctor blades. In yet another embodiment of the invention, a total clamping force of from about 14,000 lbs to about 15,000 lbs is used to secure the doctor blades. The grinding machine and abrasive media were set to control within downfeed tolerances of from about 0.1 ten-thousandths of an inch to about 10 ten-thousandths of an inch. In another embodiment, the grinding machine and abrasive media were set to control within downfeed tolerances of from about 1 ten-thousandths of an inch to about 2 ten-thousandths of an inch. In a particular embodiment, the downfeed tolerance is CNC programmable on a per time frequency basis, measured on the downfeed rate of the abrasive material itself.

The bevel surfaces were first reground with a resin bonded abrasive having a grit of from about 30 grit to about 70 grit. Another 2-8 steps of grinding is done using progressively fine grit resin bonded abrasives. In one embodiment, lubrication is applied during the grinding process. Suitable lubricants are discussed in Marinescu, Ioan D.; Tonshoff, Hans K.; Inasaki, Ichiro. *Handbook of Ceramic Grinding and Polishing*. William Andrew Publishing/Noyes (2000). The bevel surfaces of the blades polished by this method have an $R_a$ of from about 1 μ-in to 7 μ-in.

Abrasive Media

In the art, it is common to use vitreous, or hard, bonded abrasives because such abrasives tend to have a longer life than resin, or soft, bonded abrasives. However, it was surprisingly found that the resin bonded abrasive media provided bevel surfaces with a lower $R_a$ because the resin bonded abrasives tended to self clean the abrasive surface by shedding abrasive media as it was being used.

In addition, the abrasive media can include softening agents that also act to absorb the impact from the abrading of the bevel surface. Such softening agents can include, but are not limited to cork, simulated cork, seed pits, plastic, and combinations thereof. Generous amounts of cutting or grinding fluid is applied during the polishing process.

Grinding or polishing can be performed using any method known in the art, such as reciprocal surface grinding machine, rotary surface grinding machine, and cylindrical grinding machine. Suitable tools for polishing are commercially available (NexSys, Tokyo, Japan). In one embodiment, reciprocating surface grinding can be used to polish the bevel surface.

In one embodiment, a greater amount of force and higher frequency of abrasion is used during the rough grind sequence using lower grit resin bonded abrasives. As higher grit resin bonded abrasives are used, the force and frequency of abrasion is reduced. At the stage of polishing where the highest grit abrasive is used, the abrasive media is allowed to work the surface without any incremental or indexing downfeed pressure. This allows the abrasive to wear down random surface peaks, resulting in a smoother surface finish.

Test Methods

Laboratory Conditions:

All conditioning and testing is performed under TAPPI standard conditions 50.0%±2.0% R.H. and 23.0±1.0° C. (T204 om-88). All samples are conditioned for a minimum of 2 hours before testing.

Surface Roughness Method:

A Mitutoyo model SJ-400 profilometer (Mitutoyo Corp., Aurora, Ill.) was used to obtain surface finish measurements in accordance with the Japanese standard JIS B0601-2001. 6 inch samples of the doctor blades being measured were obtained by cross-sectioning the doctor blades. Special care was taken to preserve the bevel business surface as originally manufactured. The profilometer software was set to use a Gaussian distribution of data method. In addition, the software was programmed with a default setting of five cutoffs ($L_c$) and a length of cutoff that varied depending on the direction of stylus travel.

The profilometer was first calibrated using a master step gage (Mitutoyo part number 178-612, purchased with a Certificate of Inspection report.) The master step gage exhibits two nominal steps of 2 microns and 10 microns which are in turn used to calibrate the instrument as instructed by the Mitutoyo SJ-400 User's Manual (No. 99MBB093A).

All surface finish measurements were taken with the direction of stylus travel being normal to or perpendicular to the machine tool marks on the doctor blade bevel. Polished blades consisted of machining in the MD orientation on a paper machine versus skived blades which exhibit machining in the CD paper machine orientation. In other words, surface finish measurements on polished blades were taken with the stylus moving in the x-direction of the blade while skived blades were measured with the stylus moving in the z-direction of the blade. For this reason cutoff length ($L_c$) was changed from a default setting of 0.030 inches for polished blades to a cutoff length of 0.003 inches for skived blades to accommodate a shorter allowable total stylus travel across a creper blade of only 0.050 inches thickness. Thus, the total stylus travel of 0.150 inches (5 cutoffs times 0.030 inches per cutoff) was selected for polished blades while 0.015 inch total stylus travel was selected for skived blades.

Surface finish data was typically recorded as an average of three readings per blade sample using a stylus tip radius of 2 microns (Mitutoyo part number 12AAC731). This stylus tip material consists of diamond with a 60 degree conical tip shape. In addition, the supporting nosepiece consisted of a skidless design (Mitutoyo part number 12AAB355).

Example

Polishing the Doctor Blade

Current Invention

A commercially available doctor blade (Ross 420 Stainless Steel) is used as stock from the vendor (James Ross Limited, Ontario, Canada). 15 blades are secured in a hydraulic clamp fixture such that the bevel surfaces are aligned and can be polished at once. A hydraulic line pressure of 2844 psi is supplied to cylinders having a piston diameter of about 0.795 in (corresponding piston cross-sectional area of about 0.497 $in^2$). The force per piston is 1,413 lbs, and 10 pistons are used, thus the total clamping force is 14,130 lbs evenly distributed across the surface of the blade. The load per unit length for 230 inch (19.17 ft) creper blades is 737 lbs/ft. The grinding machine and abrasive media are set to control precisely within downfeed tolerances of one ten-thousandths of an inch and CNC programmable on a per time frequency basis, measured on the downfeed rate of the abrasive material itself, and the downfeed pressure can be stopped to within one ten-thousandths of an inch.

The bevel surfaces are first reground with a 46 grit resin bonded abrasive. Progressively fine abrasives are used with proper lubrication moving from a grinding to a polishing method with progressively less downfeed rate and long periods of precision polishing using softer abrasive media, defined as softer adhesives that bind the mineral grit, finishing with a 220 grit cork filled resin bonded grinding wheel. The progression of abrasive selection is known in the art. A reciprocating surface grinding technique is used on the blades. During the last polishing step, the blades are held for 20 strokes at a rate of about 0.1 m/s with no downfeed pressure. The bevel surfaces of the blades polished by this method have an $R_a$ of from about 1 μ-in to about 7 μ-in.

All documents cited in the Detailed Description of the Invention are, in relevant part, incorporated herein by reference, the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

Herein, "comprising" means the term "comprising" and can include "consisting of" and "consisting essentially of."

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A creper blade comprising: a body having a thickness, a leading side, a trailing side, CD smoothness (Ra), and working end comprising a bevel surface, wherein the bevel surface is defined by a leading edge and a trailing edge, and wherein the ($R_a$) of the bevel surface is from about 1 μ-in to about 7 μ-in, and wherein the creper blade is constructed of metal.

2. The creper blade of claim 1 wherein the $R_a$ of the bevel surface is from about 1.5 μ-in to about 5 μ-in.

3. The creper blade of claim 2 wherein the $R_a$ of the bevel surface is from about 2 μ-in to about 4 μ-in.

4. The creper blade of claim 1 wherein the blade is from about 40 inches to about 300 inches in length.

5. The creper blade of claim 4 wherein the blade is from about 100 inches to about 250 inches in length.

6. The creper blade of claim 5 wherein the blade is from about 150 inches to about 220 inches in length.

7. The creper blade of claim 1 wherein the blade is from about 2 inches to about 8 inches in height.

8. The creper blade of claim 7 wherein the blade is from about 4 inches to about 6 inches in height.

9. The creper blade of claim 1 wherein the blade has a bevel surface length of from about 0.01 inches to about 0.10 inches.

10. The creper blade of claim 9 wherein the blade has a bevel surface length of from about 0.02 inches to about 0.08 inches.

11. The creper blade of claim 10 wherein the blade has a bevel surface length of from about 0.04 inches to about 0.06 inches.

12. The creper blade of claim 1 wherein the bevel angle is from about 15 degrees to about 45 degrees.

13. A creper blade comprising: a body having a thickness, a sharp leading side, a trailing side, CD smoothness ($R_a$), and working end comprising a bevel surface, wherein the bevel surface is defined by a leading edge and a trailing edge, wherein the $R_a$ of the bevel surface is from about 1 μ-in to about 7 μ-in, the blade is from about 150 inches to about 250 inches in length, the blade is from about 4 inches to about 6 inches in height, the blade is from about 0.01 inches to about 0.10 inches in thickness, wherein the creper blade is constructed of metal and wherein the bevel angle is from about 15 to about 45 degrees.

* * * * *